US005134797A

United States Patent [19]

Turner

[11] Patent Number: 5,134,797

[45] Date of Patent: Aug. 4, 1992

[54] SAFETY VEST FOR FIREARM

[76] Inventor: Harold W. Turner, P.O. Box 652, Corbin, Ky. 40701

[21] Appl. No.: 660,745

[22] Filed: Feb. 26, 1991

[51] Int. Cl.[5] ..... F41C 27/00; F41A 17/00

[52] U.S. Cl. ..... 42/85; 42/90

[58] Field of Search ..... 42/85, 90, 71.01; 224/149, 150, 254, 255, 269

[56] References Cited

U.S. PATENT DOCUMENTS

| | | | |
|---|---|---|---|
| 2,423,531 | 7/1947 | Theis | 224/149 |
| 2,536,252 | 1/1951 | Bates | 42/85 |
| 2,614,355 | 10/1952 | Rogers et al. | 42/85 |
| 3,081,923 | 3/1963 | Bagby | 224/149 |
| 3,348,746 | 10/1967 | Stumpf | 224/149 |
| 3,430,828 | 3/1969 | Gregson | 224/149 |
| 3,441,185 | 4/1969 | Moomaw | 224/149 |
| 3,528,108 | 9/1970 | Smith | 2/94 |
| 3,606,109 | 9/1971 | Brokus | 224/149 |
| 4,895,285 | 1/1990 | Dunn | 224/149 |
| 4,982,522 | 1/1991 | Norton | 42/85 |

*Primary Examiner*—Charles T. Jordan

*Attorney, Agent, or Firm*—Dickinson, Wright, Moon, Van Dusen & Freeman

[57] ABSTRACT

A safety device for a firearm such as a rifle includes a first attachment device for securing an end of a cord just below the breast of a user. A second attachment device secures the other end of the cord to the lower part of the stock of the firearm. The cord is of such a length that it is not possible for the firearm to be pointed at the head or torso of the user while the normal use of the firearm is unhindered.

9 Claims, 2 Drawing Sheets

FIG. 3
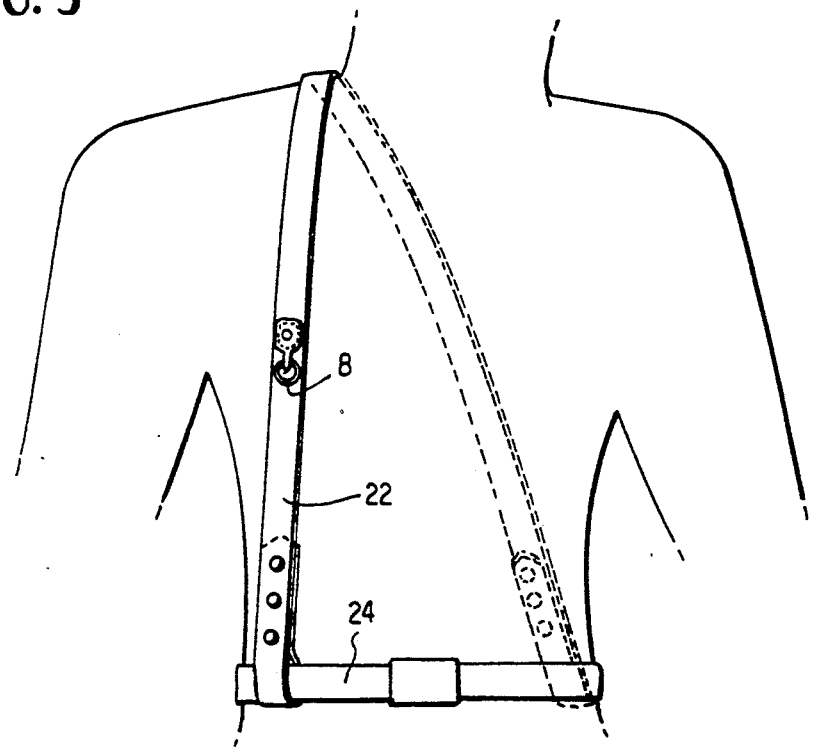
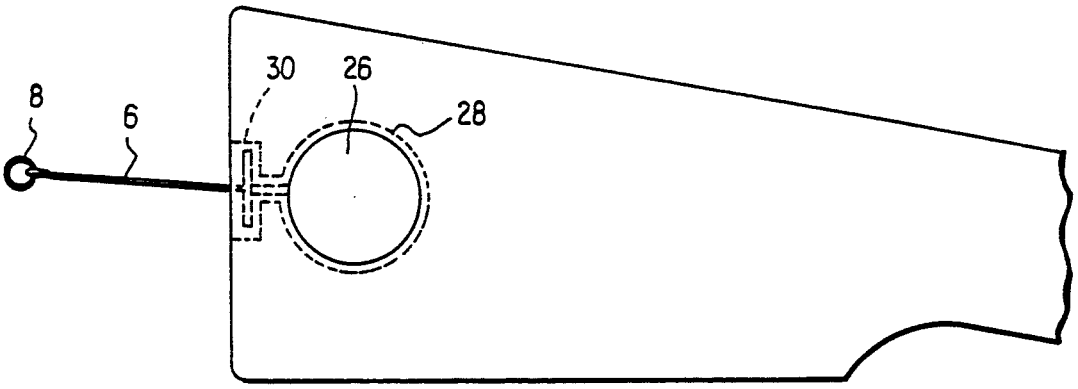
FIG. 4

SAFETY VEST FOR FIREARM

TECHNICAL FIELD

This invention relates to a device for attachment to the user of a firearm for preventing self-infliction of a fatal wound by the user of the firearm and to provide to young users more freedom from close supervision.

BACKGROUND

A safety problem in the use of a rifle or a shotgun is that the muzzle can be pointed at the user if it is dropped or accidentally bumped. For example, a young user may not be experienced enough to maintain the position of the rifle as he/she attempts to go around or over obstacles normally encountered in the field. If the rifle is bumped against an obstacle such as a fence, fallen branch or the like, or is dropped, it is possible that the rifle will become pointed at the head or torso and discharge, resulting in serious injury.

Various supports for a rifle or a shotgun are known but these are not directed to safety. For example, U.S. Pat. No. 3,528,108 (Smith) shows a shooting jacket and the use of a known sling to support the rifle in use. Brokus U.S. Pat. No. 3,606,109 , Theis U.S. Pat. No. 2,423,531 , Dunn U.S. Pat. No. 4,895,285 , Bates U.S. Pat. No. 2,536,252 , and Stumpf U.S. Pat. No. 3,348,746 show arrangements for supporting the weight of a rifle as it is carried through the field. Bagby U.S. Pat. No. 3,081,923 , Moomaw U.S. Pat. No. 3,441,185 , and Gregson U.S. Pat. No. 3,430,828 show slings for supporting a rifle wherein the butt of the rifle may be slid along the sling.

SUMMARY OF THE INVENTION

The device of the invention is applicable to a variety of firearms, and the term "rifle" is used to denote any firearm having a stock which is held to the shoulder during firing.

In accordance with the invention, a safety device secures the stock end of a rifle to the user such that the muzzle of the rifle cannot be pointed at the head or torso of the user but does not affect the normal, safe use of the rifle.

The apparatus of the invention comprises means for securing one end of a cord to the user at a location just below the user's breast and displaced slightly laterally, means for securing the other end of the cord to the shoulder end of the rifle stock, and a cord. The length of the cord is such that the end of the rifle may be easily brought to the shoulder of the user when firing in the normal manner but cannot be held in such a position that the muzzle may be pointed at the face or torso of the user. The length of the cord will vary according to the size of the user, and the length is preferably adjustable. In a preferred embodiment, the length is about 12"-14". The only parts of the body of the user which can possibly be shot when using the safety device of the invention are the extremities of the limbs, such as the hands, lower parts of the legs, and the feet. An injury to these parts is not likely to be fatal, resulting in far safer use of the rifle, particularly with inexperienced users such as children.

The means for securing one end of the cord to the user may be a metal ring secured to an article of apparel worn by the user, such as a jacket, coat, shirt, or vest. The ring may be held on a patch of strong material, such as leather, and the patch may be sewn to any of a variety of known pieces of apparel worn by hunters. Or, the ring may be attached directly to the article of apparel, such as by stitching. The first end of the cord may have any one of a variety of known detachable clips which can be easily attached to or removed from the ring. The rifle may have a similar ring for receiving a detachable clip on the opposite end of the cord, or the ring may be secured to a sleeve, such as a known shock absorbing sleeve which fits over the end of the rifle stock.

In another embodiment, a winding mechanism is placed in a recess in the end of the rifle stock, and the cord may be drawn out and secured to the ring on the user when the firearm is to be used. When the firearm is not in use, the cord is conveniently rewound into the recess, such as by a spring mechanism, for storage.

BRIEF DESCRIPTION OF THE DRAWINGS

FIG. 3 shows the use of a strap to secure the cord to the user.

FIG. 4 illustrates a retractable cord.

DETAILED DESCRIPTION OF THE DRAWINGS

Figure 1:
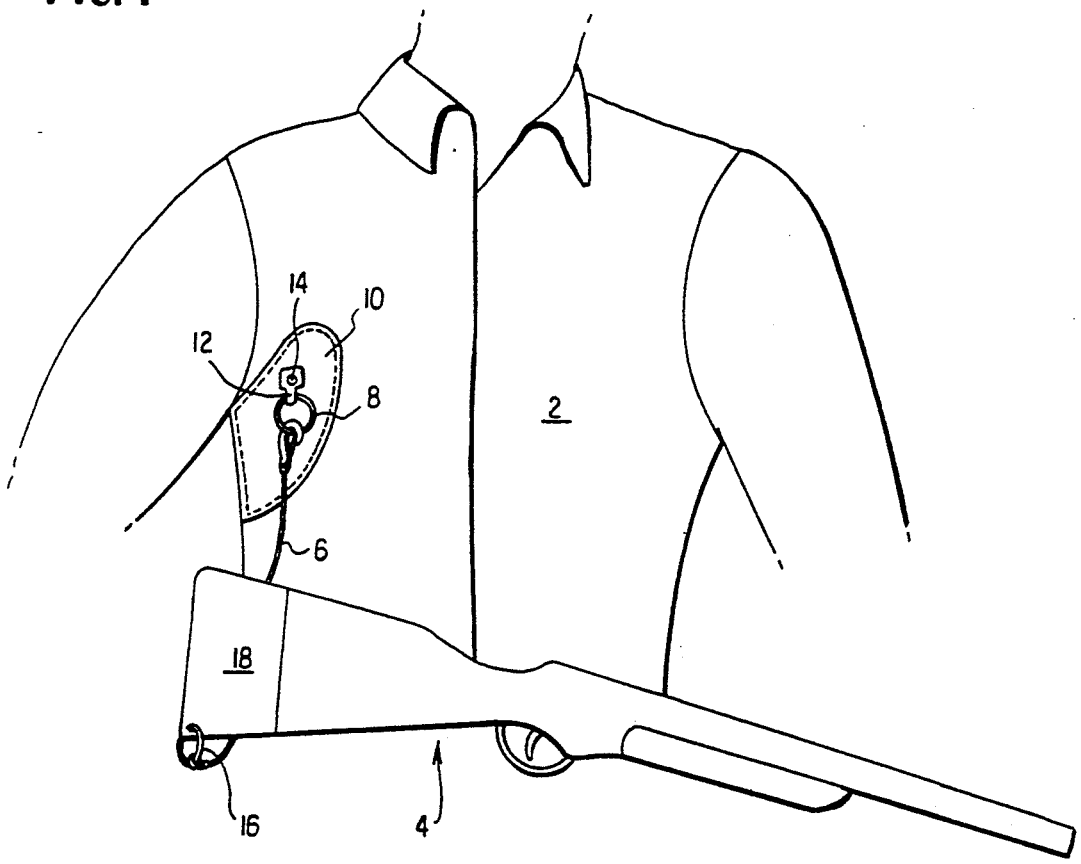
FIG.1 shows a safety device in accordance with the invention in use with a hunter's vest and a rifle.

With reference to FIG. 1 of the drawings, a user is wearing an article of apparel shown here as a vest 2 and is carrying a rifle 4. A safety cord 6 is attached between the lower end of the rifle stock and the vest to prevent movement of the lower end of the of the rifle away from the user by such a distance that the muzzle of the rifle can be pointed at the head or torso of the user. This length will depend on the size of the user, but may be, for example, twelve to fourteen inches.

The cord is secured to the user at a location just below the breast and displaced laterally to allow the firearm to be raised to the firing position without hinderance. In the embodiment shown in FIG. 1, the attachment means comprises a metal ring 8 which is held to a patch 10 of leather or other strong material. The patch is then secured to the vest 2 as by sewing, or the like. The ring may be held to the patch by any of a variety of techniques. One such technique is shown in FIG. 1 wherein a loop 12 passes through the ring 8 and is held to the patch such as by rivet 14. The ring may also be sewn to the patch or attached in a variety of other ways.

The other end of the cord may be secured to the end of the rifle stock in a variety of ways. FIG. 1 shows a second ring 16 secured to a sleeve 18 which fits over the end of the rifle stock. The ring passes through a hole in the sleeve such that the ring does not interfere with normal use of the rifle by a user.

Figure 2:
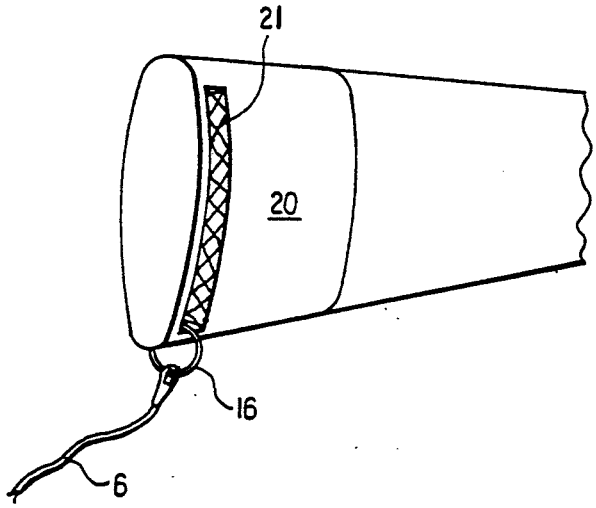
FIG. 2 shows an alternative method for attaching the cord to the rifle.

It will be appreciated that the ring 16 may be attached to the rifle in a variety of other ways. For example, the ring may pass through the eye of a threaded stem which may be screwed into the lower part of the stock of the rifle. Another example is shown in FIG. 2 where a shock absorbing sleeve 20 has open areas 21 filled with webbing to absorb shock. If the sleeve is of the type in which the open areas pass through the sleeve, the ring may easily be passed through one of the open areas. If the open areas do not extend completely through the sleeve, a small hole for the ring may be drilled through the web connecting open areas on opposite sides of the sleeve and the ring 16 passed through the hole and contiguous open areas.

The ends of the cord comprise clips which may be easily attached and detached. For example, a known clip is a hook with a flexible piece over the clip which allows a ring to be placed in the hook or pressed inward to allow the ring to be removed. Another alternative is a threaded swivel on the ring 8 and a threaded part on the cord. The swivel can then be easily screwed to the end of the cord when the firearm is to be taken into the field.

FIG. 3 shows a strap 22 which is secured to a belt 24 of generally known design. Ring 8 is attached to the strap in a manner similar to that described above for receipt of the end of the cord 6. This is useful for those situations where the article of apparel such as the vest 2 in FIG. 1 is not worn.

FIG. 4 illustrates yet another embodiment. According to this embodiment, the cord 6 is connected to a winding mechanism 26 which is located in a recess 28 in the shoulder end part of the stock of the firearm. A smaller recess 30 is provided to receive the ring when the cord is wound. Of course, the two recesses may be combined. The cord 6 may have a length adequate to protect an adult as well as a child, the winding mechanism having a length adjustment feature.

It will be appreciated that a safety device easily adaptable to a firearm without detracting from its appearance has been described. Modifications within the scope of the appended claims will be apparent to those of skill in the art.

I claim:

1. A safety device for a firearm of the type that is of substantial length and has a stock designed to be held to the shoulder of a user when in a normal firing position, said safety device comprising cord means for controlling the range of movement of said stock with respect to said user, means for attaching one end of said cord means to a location near said shoulder of a user, and means for securing a second end of said cord means to said stock of said firearm, wherein said cord means permits said stock of said firearm to be easily placed in said normal firing position by said user and restricts the movement of said stock relative to said location to a range such that the muzzle of said firearm cannot be aimed at the torso or head of said user.

2. A safety device according to claim 1 wherein said means for securing one end of said cord means near a shoulder comprises a ring attached to a garment to be worn by said user.

3. A safety device according to claim 2 wherein said ring is attached to a patch which is attached to said garment.

4. A safety device according to claim 1 wherein said means for securing one end of said cord means near a shoulder comprises a ring secured to a strap to be worn by said user.

5. A safety device according to claim 1 wherein said means for securing a second end of said cord means comprises a sleeve for fitting over and being secured to the stock of said firearm.

6. A safety device according to claim 1 wherein said means for securing a second end of said cord means comprises a ring on the stock of said firearm.

7. A safety device according to claim 1 wherein said means for securing a second end of said cord means is in a recess in the stock of said firearm.

8. A safety device according to claim 7 further comprising means for retracting said cord means into said recess.

9. In combination, a firearm and a safety device, wherein said firearm is of substantial length and comprises a stock at one end thereof and a muzzle at an oppsosite end spaced from said stock, and said safety device comprises means for attaching said stock to the body of a user for restricting the movement of said stock with respect to said body of a user within a range for allowing unhindered normal operation of the firearm and preventing the inadvertent aiming of the muzzle at the head or torso of said user.

* * * * *